US007444844B1

(12) United States Patent
Lee

(10) Patent No.: US 7,444,844 B1
(45) Date of Patent: Nov. 4, 2008

(54) DUAL-MODE LOCK FOR LOCKERS

(75) Inventor: Miko Lee, Hsinchuang (TW)

(73) Assignee: ABA UFO International Corp., Hsin Chuang, Taipei Hsien (TW)

( * ) Notice: Subject to any disclaimer, the term of this patent is extended or adjusted under 35 U.S.C. 154(b) by 0 days.

(21) Appl. No.: 12/000,817

(22) Filed: Dec. 18, 2007

(51) Int. Cl.
*E05B 37/00* (2006.01)

(52) U.S. Cl. ..... 70/21; 70/213; 70/284; 70/285; 70/312; 70/491

(58) Field of Classification Search ..... 70/21, 70/58, 213, 219, 284, 285, 312, 403, 404, 70/491, 496, DIG. 63, DIG. 71
See application file for complete search history.

(56) References Cited

U.S. PATENT DOCUMENTS

| | | | | | |
|---|---|---|---|---|---|
| 4,770,013 | A * | 9/1988 | Nakai | 70/285 |
| 4,885,923 | A * | 12/1989 | Nakai | 70/284 |
| 5,345,798 | A * | 9/1994 | Nakai | 70/284 |
| 5,661,991 | A * | 9/1997 | Hsu | 70/312 |
| 5,906,124 | A * | 5/1999 | Su | 70/312 |
| 6,463,770 | B1 * | 10/2002 | Lee | 70/58 |
| 6,508,089 | B1 * | 1/2003 | Tsai | 70/213 |
| 6,513,356 | B1 * | 2/2003 | Yang | 70/213 |
| 7,370,499 | B1 * | 5/2008 | Lee | 70/58 |
| 2002/0139155 | A1 * | 10/2002 | Franzen | 70/213 |
| 2003/0089147 | A1 * | 5/2003 | Yang | 70/284 |
| 2004/0011098 | A1 * | 1/2004 | Yang | 70/284 |
| 2007/0214850 | A1 * | 9/2007 | Ma | 70/284 |

* cited by examiner

*Primary Examiner*—Lloyd A Gall
(74) *Attorney, Agent, or Firm*—Bacon & Thomas, PLLC

(57) ABSTRACT

A dual-mode lock for a locker has a base, a knob, a key lock assembly, a housing and a combination lock assembly. The base is mounted through the locker. The knob is attached to the base. The key lock assembly is mounted in the knob, and has a lock core mounted rotatably through the base and having a latch for locking the locker. The housing is attached to the base and has a combination mount. The combination lock assembly is mounted in the combination mount to selectively lock or allow the lock core to rotate. Therefore, if a combination is forgotten or lost, the dual-mode lock may be opened quickly with a corresponding key and the combination reset reducing building management stress and preventing replacement costs.

12 Claims, 12 Drawing Sheets

DUAL-MODE LOCK FOR LOCKERS

BACKGROUND OF THE INVENTION

1. Field of the Invention

The present invention relates to a dual-mode lock, and more particularly to a dual-mode lock for lockers to allow the lockers to be opened when a combination is lost.

2. Description of the Prior Arts

Lockers are provided in many public places such as gyms, swimming pools, health spas, sports clubs and the like, for people to lock away personal items such as clothes and valuables.

Some lockers are dual-mode lockers that require a specific sequence of numbers to be entered on dials called the combination, where a person sets a personal combination before closing a door. However, the combination must be remembered. If the combination is forgotten, the lock cannot be unlocked since no-one else is privy to the personal combination. This is inconvenient for people who don't remember numbers well. Moreover, some people find dual-mode lockers hard to use and set an incorrect combination.

To overcome the shortcomings, the present invention provides a dual-mode lock for a locker to mitigate or obviate the aforementioned problems.

SUMMARY OF THE INVENTION

The primary objective of the present invention is to provide a dual-mode lock for a locker that is capable of being unlocked by a correct combination or a corresponding key.

The dual-mode lock for a locker has a base, a knob, a key lock assembly, a housing and a combination lock assembly. The base is mounted through the door. The knob is attached to the base. The key lock assembly is mounted in the knob, and has a lock core mounted rotatably through the base and having a latch for locking the locker. The housing is attached to the base and has a combination mount. The combination lock assembly is mounted in the combination mount to selectively lock or allow the lock core to rotate. Therefore, if a combination is forgotten or lost, the dual-mode lock may be opened quickly with the corresponding key and the combination reset reducing building management stress and preventing replacement costs.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
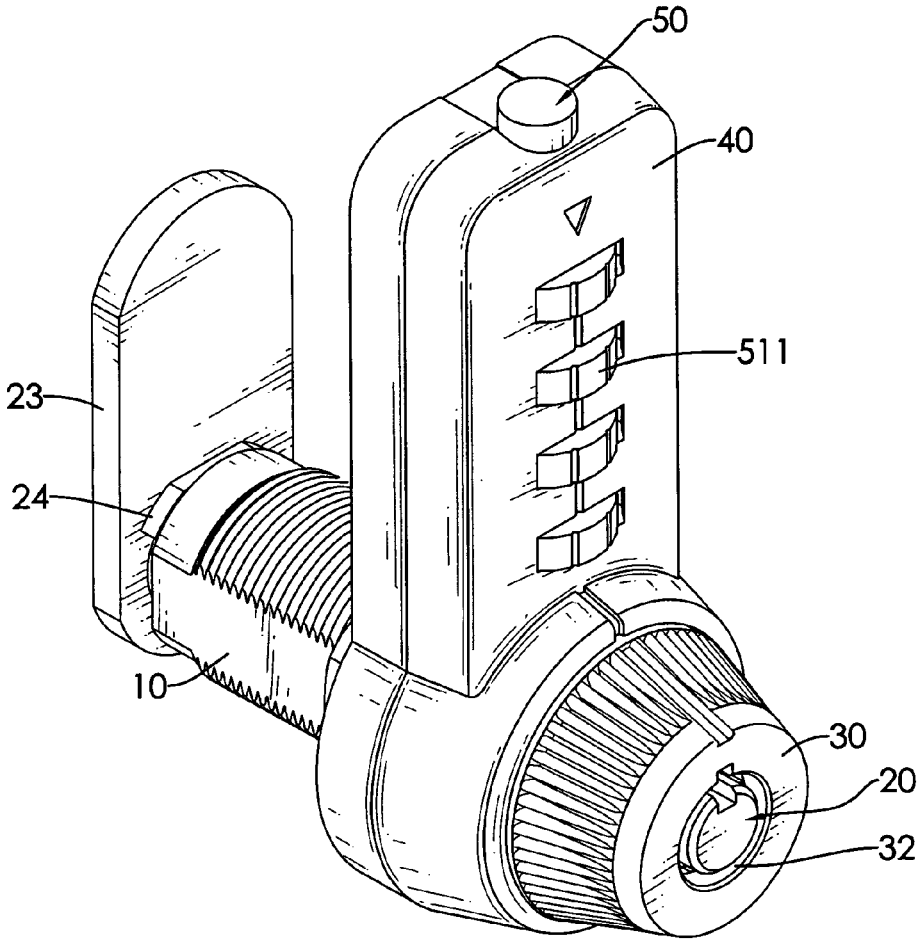
FIG. 1 is a perspective view of a dual-mode lock for a locker in accordance with the present invention.
Figure 2:
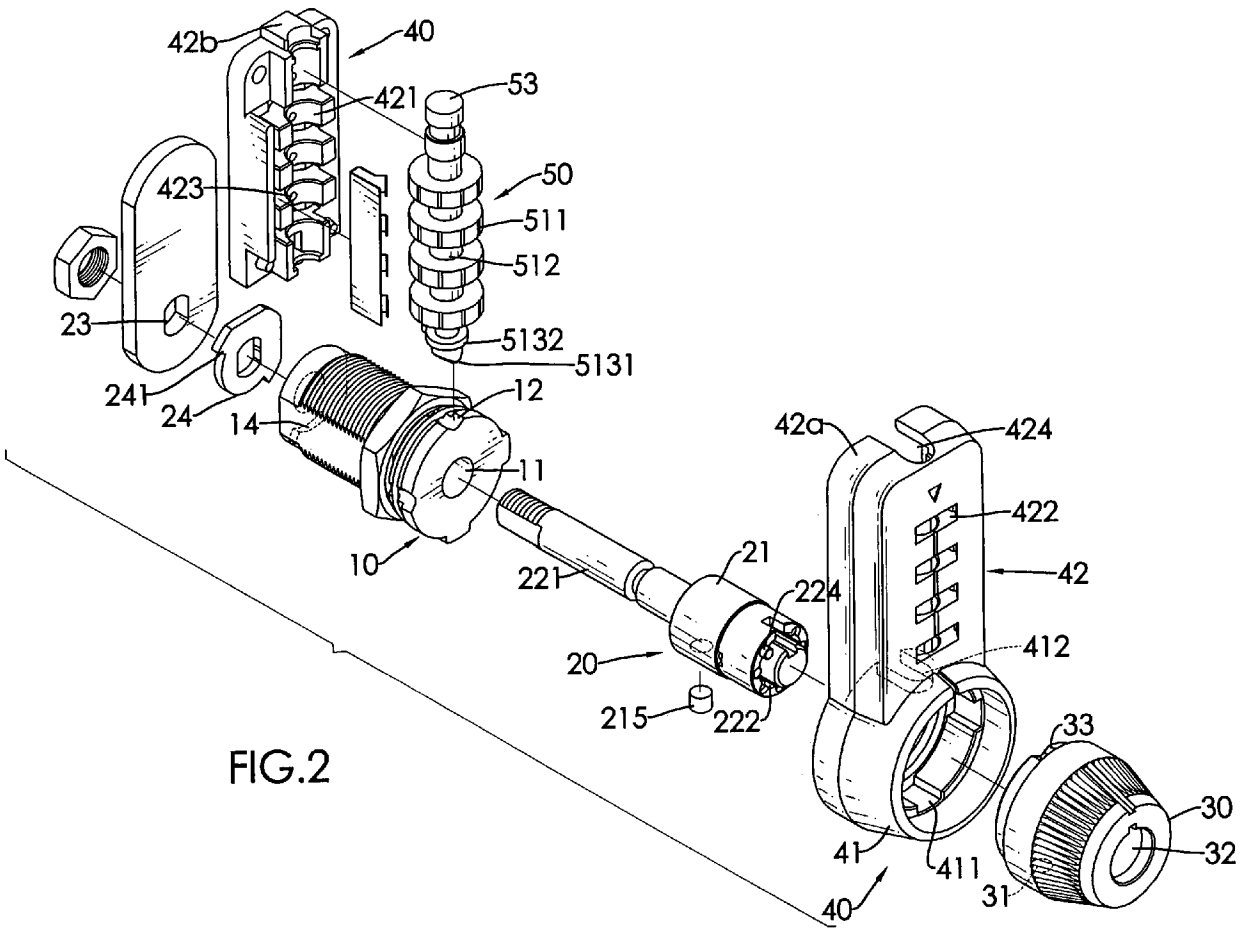
FIG. 2 is an exploded perspective view of the dual-mode lock in FIG. 1.

With reference to FIGS. 1 and 2, a dual-mode lock for a locker in accordance with the present invention is mounted on and locks a door of the locker and comprises a base (10), a knob (30), a key lock assembly (20), a housing (40) and a combination lock assembly (50).

The door of the locker has a front side and a rear side.

The base (10) is mounted securely through the door of the locker and has a front end, a rear end, an outer surface, a through hole (11), an engaging detent (12) and an optional limit (14).

The rear end of the base (10) protrudes out of the rear side of the door.

The through hole (11) is formed coaxially through the base (10).

The engaging detent (12) is formed in the outer surface of the base (10) near the front end and may be V-shaped.

The limit (14) is formed on and protrudes longitudinally from the rear end of the base (10).

Figure 3:
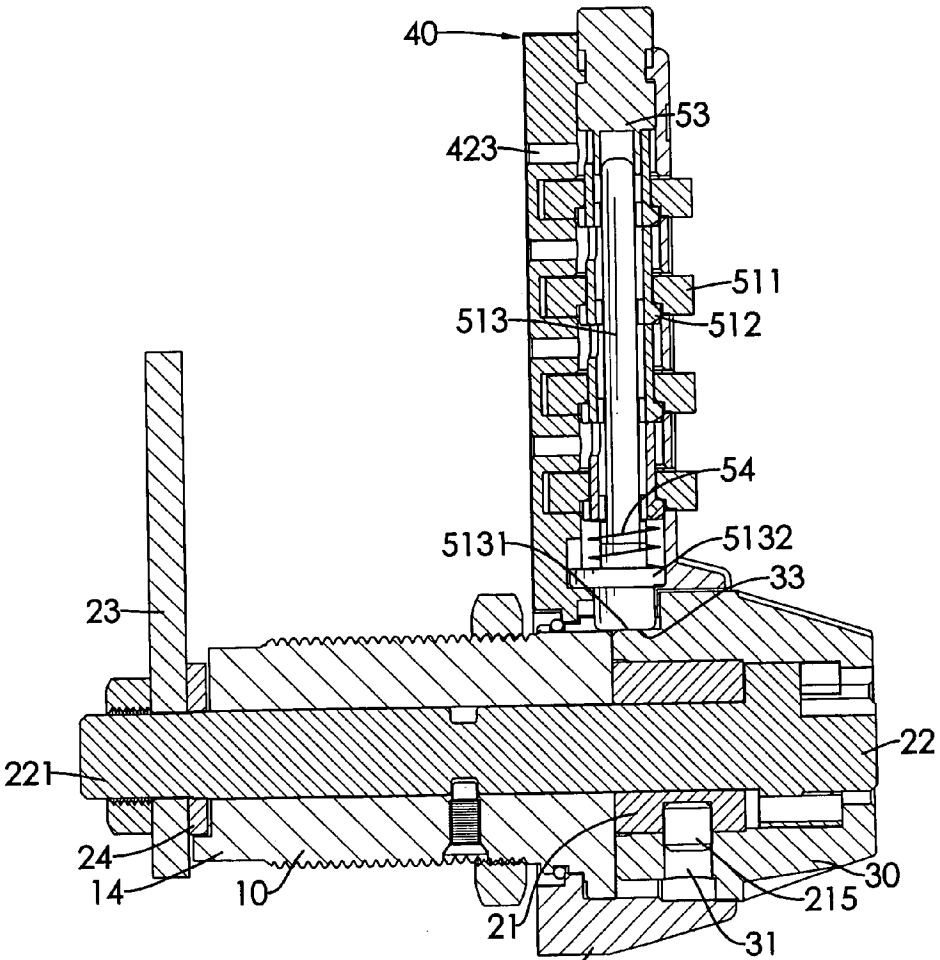
FIG. 3 is a cross-sectional side view of the dual-mode lock in FIG. 1.

With further reference to FIG. 3, the knob (30) is mounted on the front side of the door, is rotatably attached coaxially to the front end of the base (10), and has a front end, a rear end, an outer surface, an inner surface, a lock core cavity, a key hole (32) and an engaging detent (33) and may have a mounting hole (31).

The lock core cavity of the knob (30) is formed in the rear end of the knob (30) and aligns with the through hole (11) of the base (10).

The key hole (32) is formed through the front end of the knob (30), communicates and aligns with the lock core cavity.

The engaging detent (33) is formed on the outer surface of the knob (30) near the rear end, may be V-shaped and selectively aligns with the engaging detent (12) of the base (10).

The mounting hole (31) is formed in the inner surface of the knob (30) and communicates with the lock core cavity.

Figure 4:
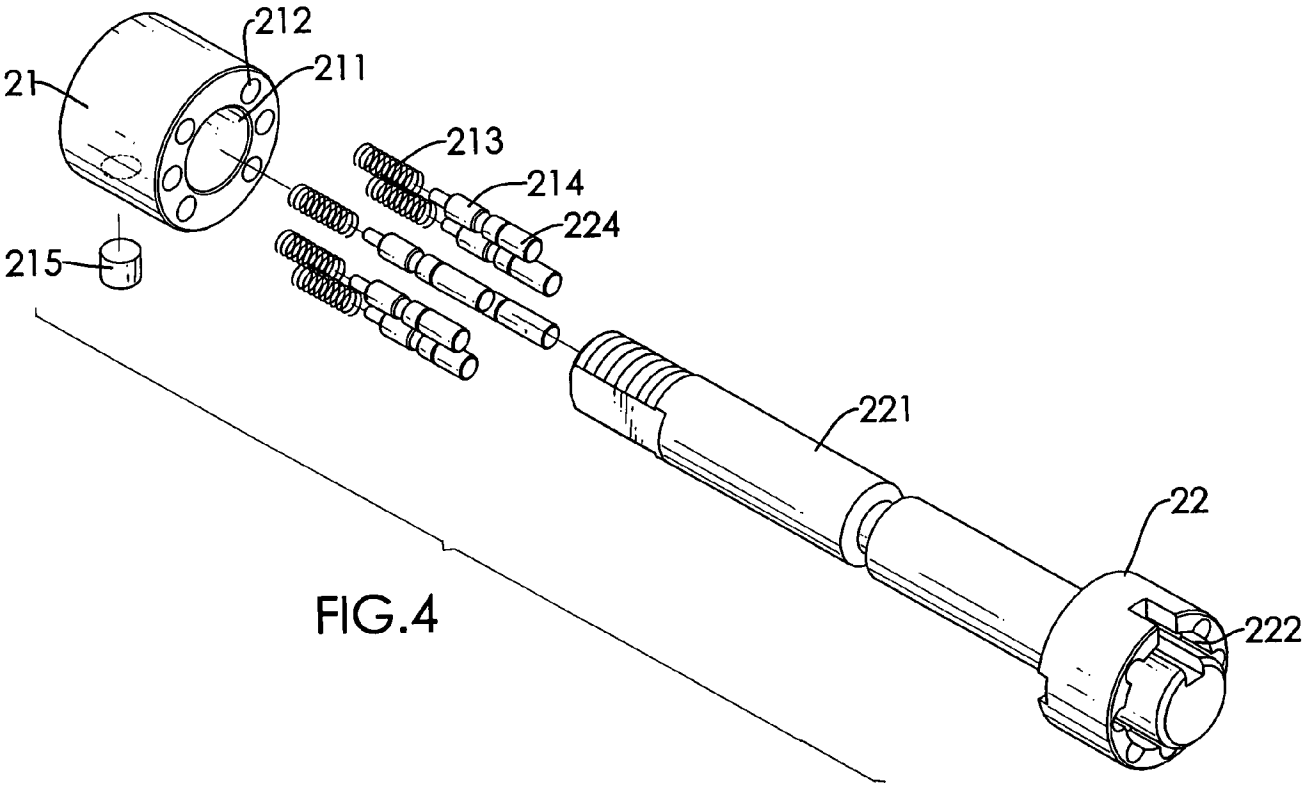
FIG. 4 is an exploded perspective view of a key lock assembly of the dual-mode lock in FIG. 1.

With further reference to FIG. 4, the key lock assembly (20) is mounted in the lock core cavity of the knob (30), is mounted through the through hole (11) of the base (10), allows a person to unlock the door using a corresponding key and has an inner core (21), a lock core (22), a latch (23) and an optional limiting ring (24).

The inner core (21) is cylindrical, is mounted adjacent to the base (10) in the lock core cavity, engages the knob (30) and has a front end, an annular wall, a shaft hole (211) and may have at least one pin chamber (212), at least one locking pin (214), at least one spring (213) and a securing protrusion (215).

The shaft hole (211) is formed coaxially through the inner core (21) and aligns with the through hole (11) of the base (10).

Each one pin chamber (212) is formed longitudinally in the front end of the inner core (21).

Each locking pin (214) is mounted slidably in a corresponding pin chamber (212) and selectively protrudes out of the corresponding pin chamber (212).

Each spring (213) is mounted in a corresponding pin chamber (212) and presses against a corresponding locking pin (214).

The securing protrusion (215) is mounted securely in the inner surface of the inner core (21) and may be mounted securely in the mounting hole (31) to secure the inner core (21) to the knob (30).

Figure 5:
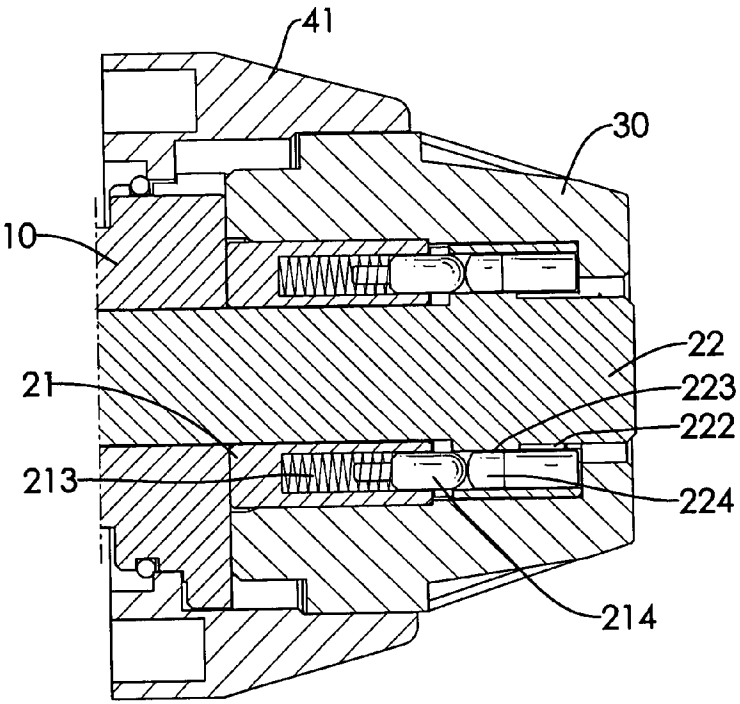
FIG. 5 is an enlarged top view in partial section, showing internal elements of the dual-mode lock in FIG. 1, shown locked.
Figure 6:
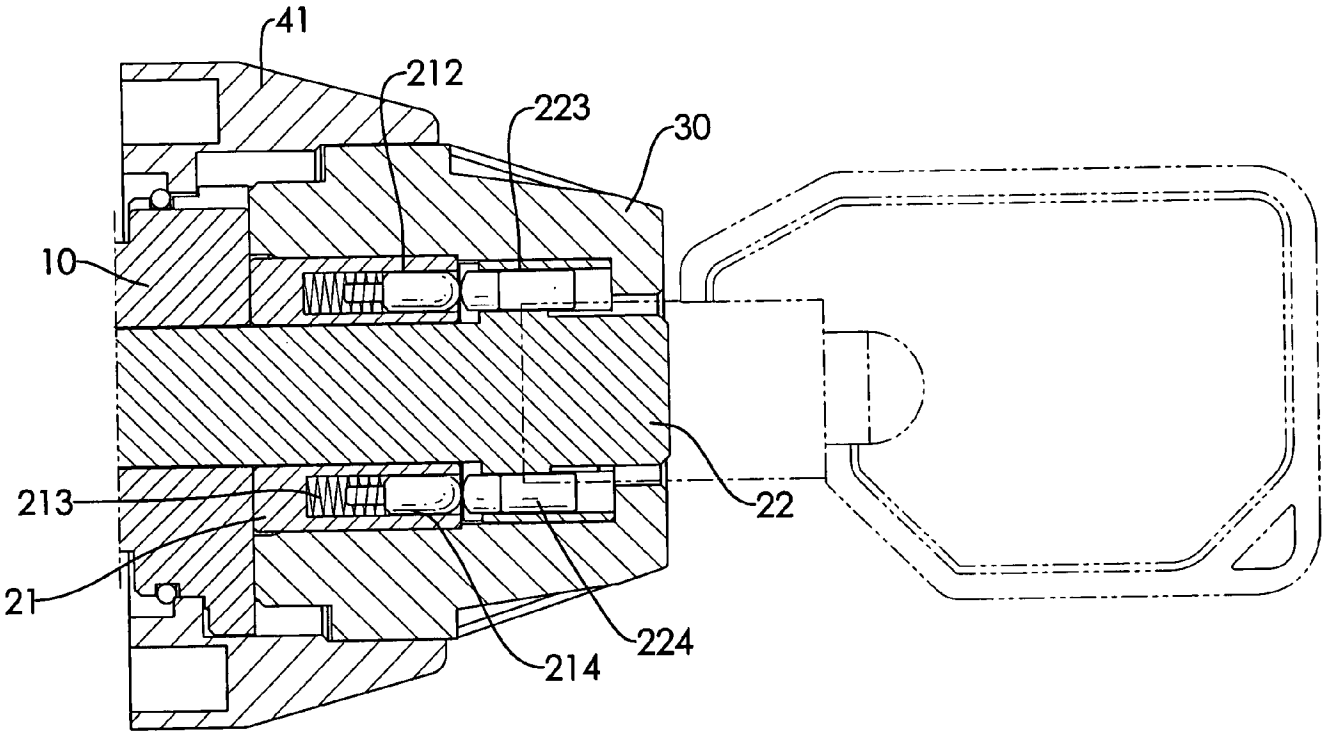
FIG. 6 is an enlarged top view of the dual-mode lock in FIG. 5, shown with a corresponding key inserted.

With further reference to FIGS. 5 and 6, the lock core (22) is cylindrical, is mounted rotatably in the lock core cavity, selectively engages the inner core (21), has a front end, a rear end, a shaft (221), a key groove (222) and may have at least one pin hole (223) and at least one pushing pin (224).

The rear end of the lock core (22) abuts the front end of the inner core (21) at a surface interface.

The shaft (221) is formed on and protrudes coaxially from the rear end of the lock core (22), is mounted rotatably through the shaft hole (211) of the inner core (21) and the through hole (11) of the base (10), protrudes out of the rear end of the base (10) and has a distal end. The distal end of the shaft (221) may be keyed.

The key groove (222) is circular, is formed concentrically in the front end of the lock core (22) and aligns with the key hole (32) of the knob (30) to allows the corresponding key to be inserted.

Each pin hole (223) is formed longitudinally in the rear end of the lock core (22) and aligns with a corresponding pin chamber (212), selectively engages a corresponding locking pin (214) when the key lock assembly (20) is locked partially aligns with and communicates with the key groove (222). Each pushing pin (224) is mounted slidably in a corresponding pin hole (223), presses against the key groove (222) and abuts a corresponding locking pin (214) at a pin interface. When the corresponding key is inserted into the key groove (222) each pushing pin (224) is pushed out of the pin hole (223) so the pin interface aligns with the surface interface, thereby unlocking the key lock assembly (20) and allowing the lock core (22) to rotate.

The latch (23) is mounted securely on the distal end of the shaft (221) to lock the door and may have a keyed mounting hole corresponding to and being mounted securely around the distal end of the shaft (221).

The limiting ring (24) is mounted securely on the distal end of the shaft (221), has two positive stops (241) and may have a keyed mounting hole mounted securely around the distal end of the shaft. Each positive stop (241) corresponds to and selectively abuts the limit (14) to limit rotation of the lock core (22).

The housing (40) is attached to the base (10) has a proximal end, a distal end, an optional knob mount (41) and a combination mount (42).

The proximal end of the housing (40) is attached to the base (10).

The knob mount (41) is formed on the proximal end of the housing (40), is mounted around the front end of the base (10) and the rear end of the knob (30), engages the base (10) and has a mounting hole (411) and an opening (412).

The mounting hole (411) is formed coaxially through the knob mount (41) and is mounted around the front end of the base (10) and the rear end of the knob (30).

The opening (412) is formed transversely through the knob mount (41) and corresponds to the engaging detents (12, 33) of the base (10) and the knob (30).

The combination mount (42) is formed from the distal end of the housing (40), is mounted on the front side of the door and has a front side, a rear side, a distal end, a combination core cavity (421), multiple windows (422), multiple optional detecting holes (423) and a button mount (424). The combination mount (42) may comprise a combination mount base (42*a*) and a combination mount cover (42*b*). The combination mount base (42*a*) is formed on the housing (40). The combination mount cover (42*b*) is mounted on the lock core base.

The combination core cavity (421) is formed in the combination mount (42) and communicates with the mounting hole (411).

The windows (422) are formed through the front side of the combination mount (42) and communicate with the combination core cavity (421).

The detecting holes (423) are formed through the rear side of the combination mount (42), may be through the combination mount cover (42*b*), communicate with the combination core cavity (421) and correspond to the windows (422).

The button mount (424) is formed coaxially through the distal end of the combination mount (42) and communicates with the combination core cavity (421).

Figure 7:
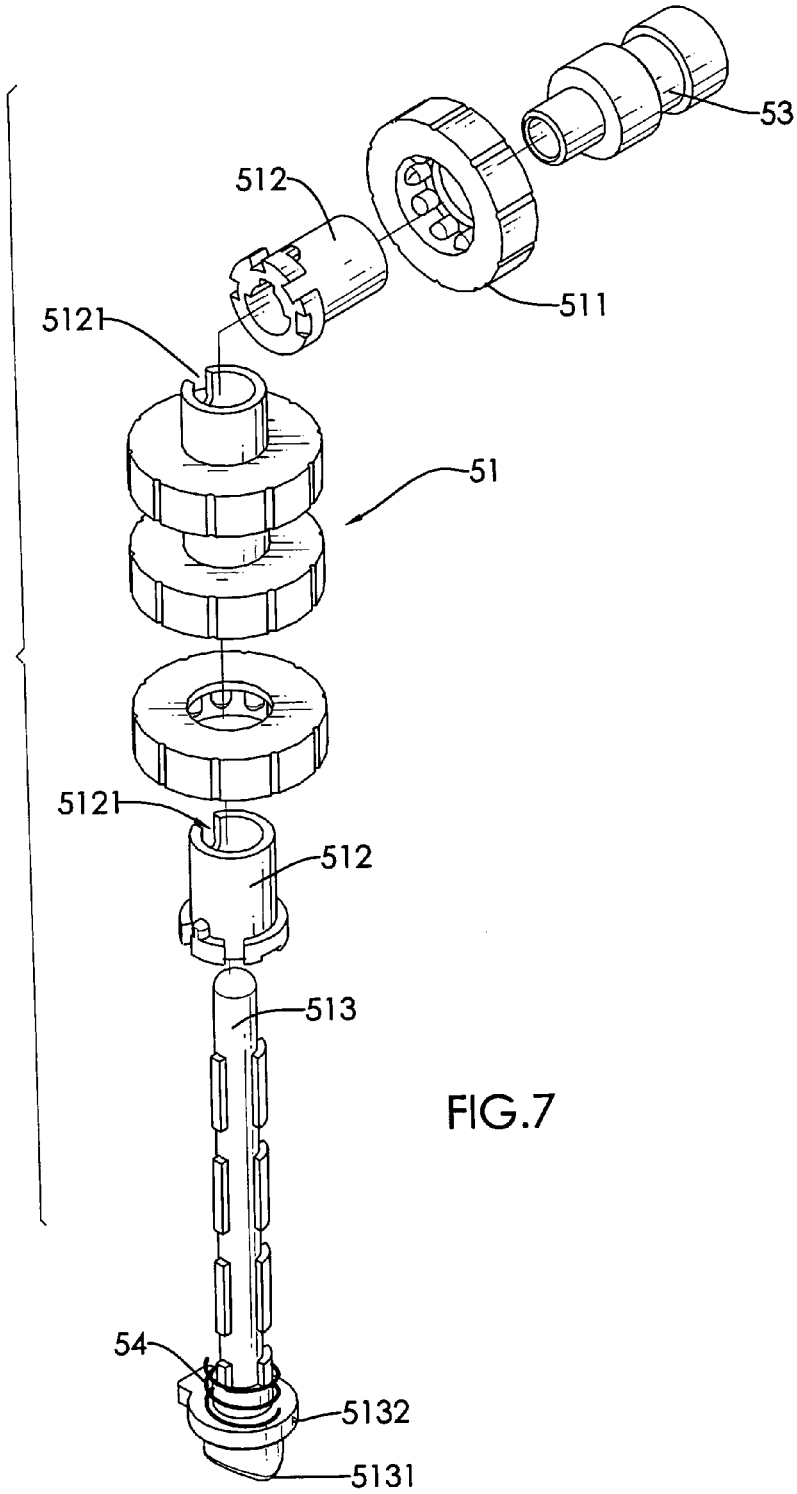
FIG. 7 is an exploded view of a combination lock assembly of the dual-mode lock in FIG. 1.
Figure 8:
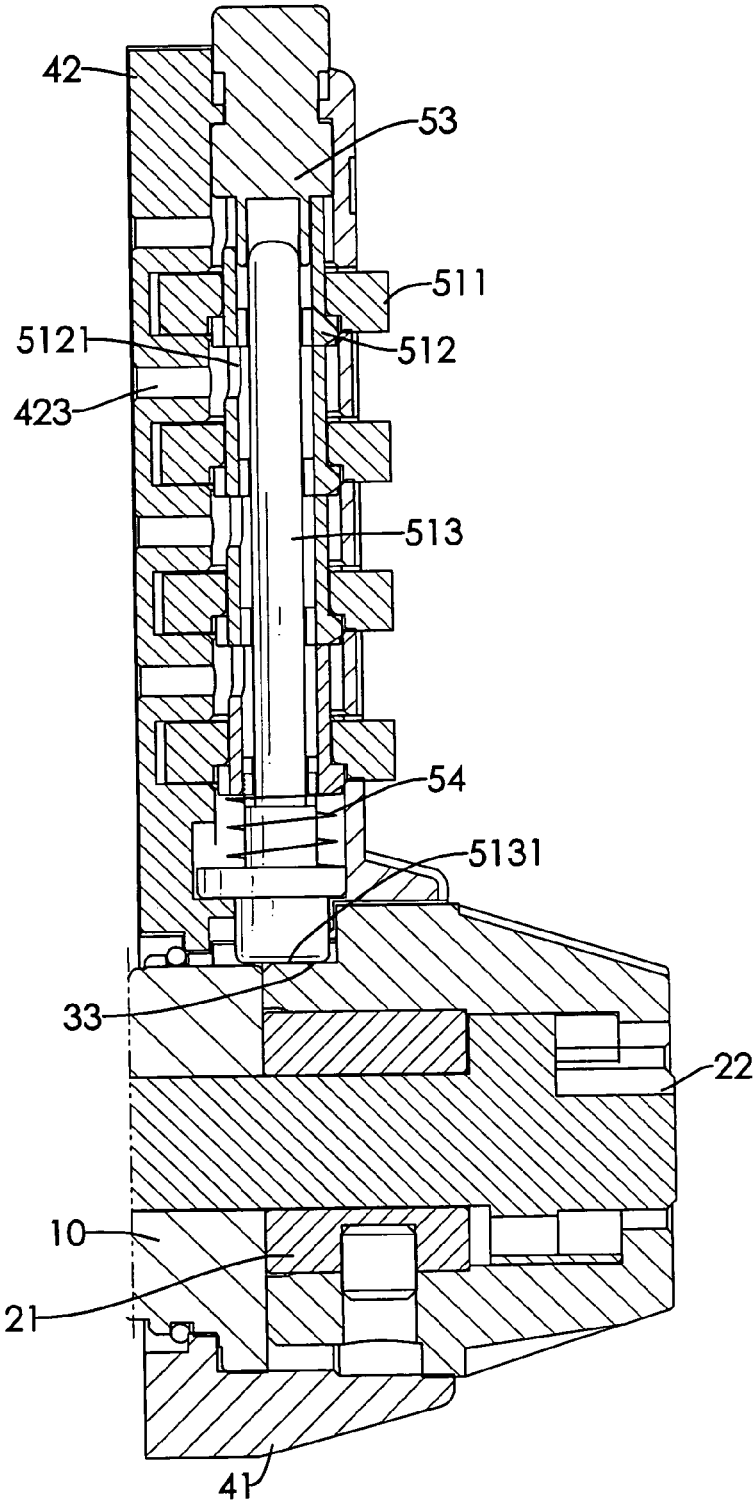
FIG. 8 is an enlarged operational side view in partial section of the dual-mode lock in FIG. 1, shown with the combination lock assembly aligned.

With further reference to FIGS. 7 and 8, the combination lock assembly (50) is mounted in the combination mount (42) and has a combination lock core (51), a button (53) and a spring (54).

The combination lock core (51) is mounted in the combination core cavity (421), provides a combination locking capability for the door and has multiple dials (511), multiple sleeves (512) and a rod (513).

The dials (511) are rotatably mounted coaxially adjacent to each other in the combination core cavity (421), correspond to and partially protrude through the windows (422) to allow the dials (511) to be rotated. When the dials (511) are aligned in a correct combination, the combination lock core (51) may be unlocked.

The sleeves (512) are tubular, are slidably mounted coaxially through the dials (511), engage the dials (511), and each sleeve has a through hole and an optional detecting opening (5121).

The through hole of the sleeve (512) is formed coaxially through the sleeve (512).

Each detecting opening (5121) corresponds to one of the detecting holes (423) and selectively aligns with the corresponding detecting hole (423) when the correct combination is inputted to allow a person to retrieve the combination by inserting a tool into the detecting hole (423) then rotating a corresponding dial (511) until the tool enters the detecting opening (5121). Therefore, allowing the combination to be recovered when lost.

The rod (513) is mounted rotatably through the through holes of the sleeves (512), is selectively slidable when the combination lock core (51) is unlocked and has an inner end, a bolt head (5131) and a lip (5132).

The bolt head (5131) is formed on the inner end of the rod (513), may be V-shaped, abuts the outer surface of the base (10) near the front end and the outer surface of the knob (30) near the rear end and engaging the engaging detents (12, 33) of the base (10) and the knob (30) when the combination lock core (51) is locked to prevent the knob (30) and the lock core (22) from rotating.

The lip (5132) is formed around the rod (513) near the inner end.

Figure 9:
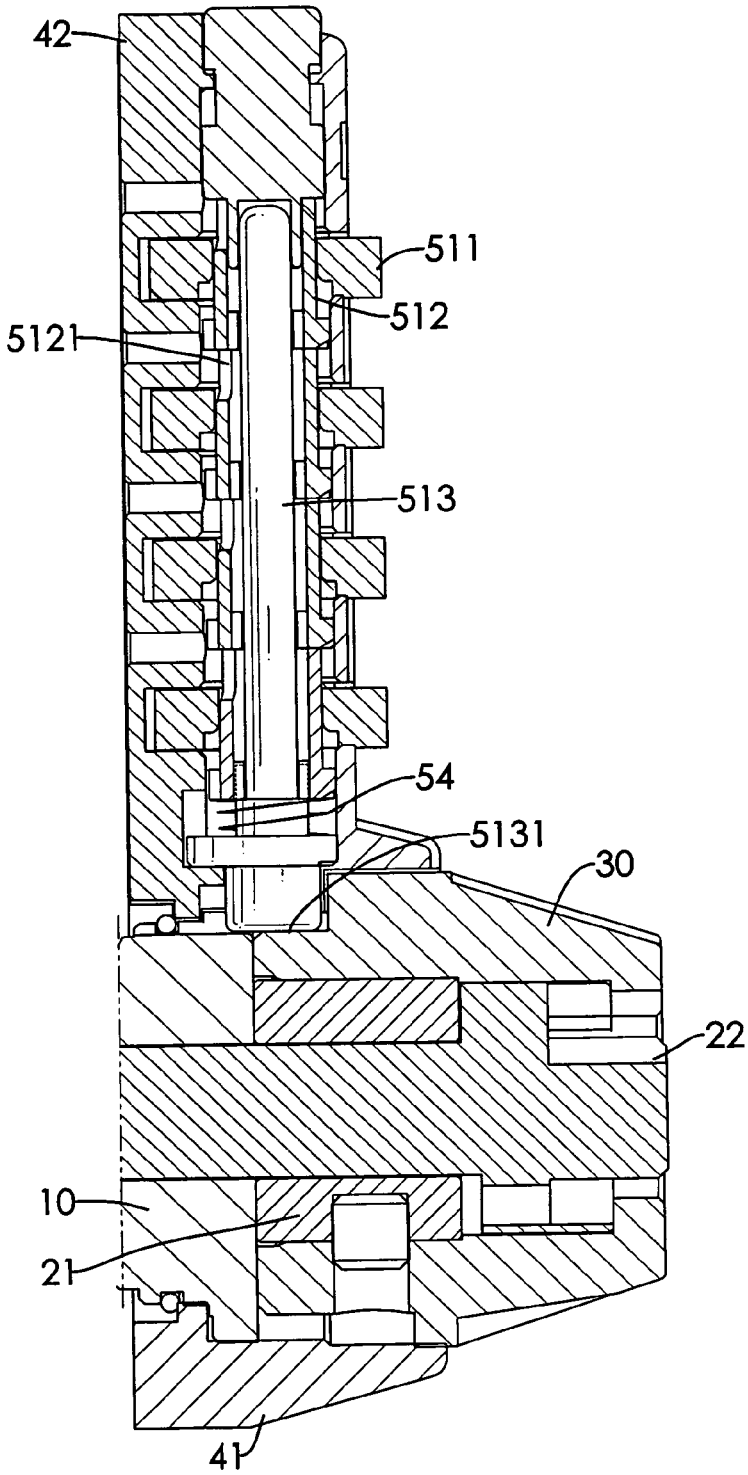
FIG. 9 is an enlarged operational side view in partial section of the dual-mode lock in FIG. 8, shown with dials disengaged to change a combination.

With further reference to FIG. 9, the button (53) is mounted slidably through the button mount (424), abuts a sleeve (512) and selectively pushes the sleeves (512) to disengage the dials (511) when the combination lock core (51) is unlocked.

Therefore, a person can change the correct combination by rotating the dials (511) to a new position and releasing the button (53).

The spring (54) is mounted around the rod (513) and is mounted between and presses against the sleeves (512) and the lip (5132) of the rod (513) to ensure the bolt head (5131) of the rod (513) engages the detents (33, 12) and the sleeves (512) reengage the dials (511) after the combination is changed.

Figure 10:
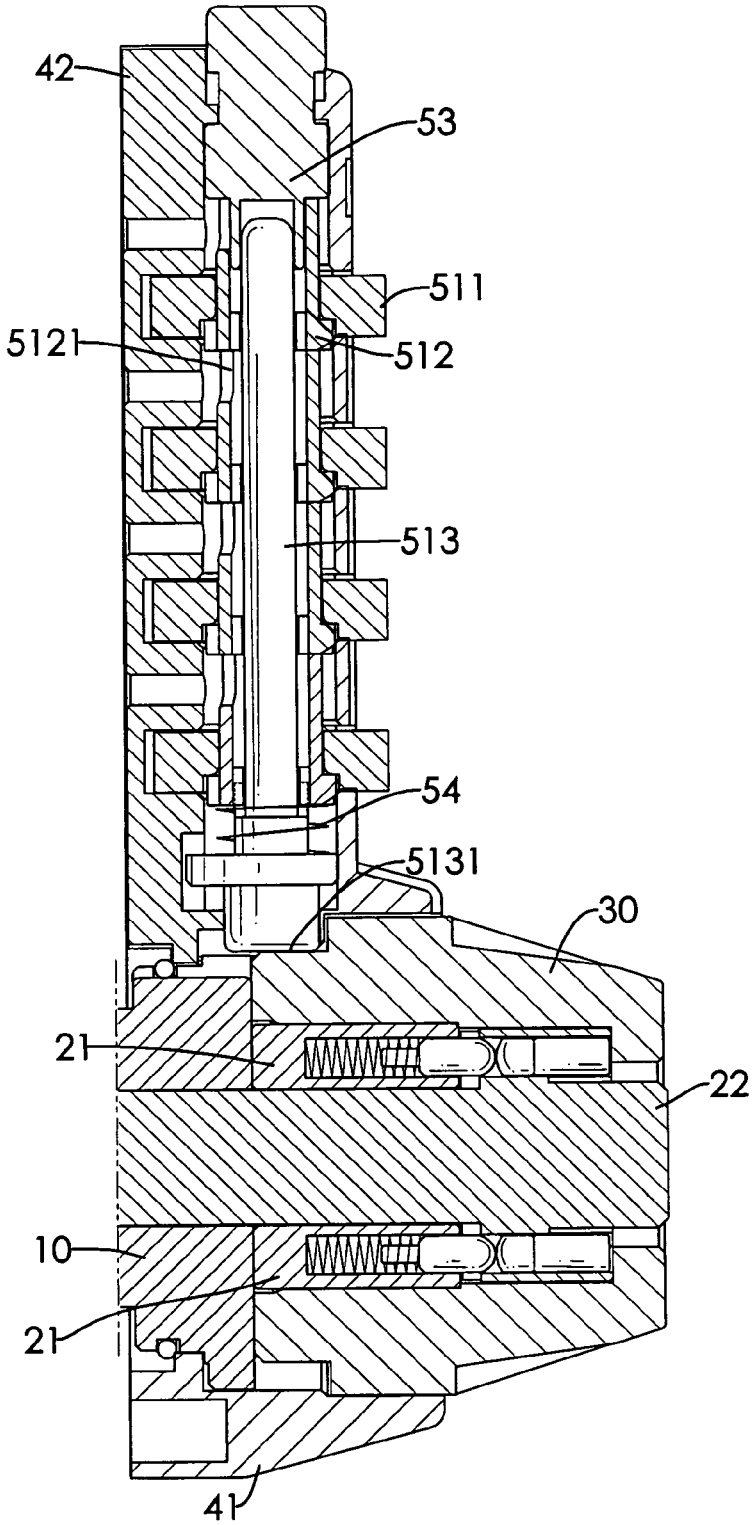
FIG. 10 is an enlarged operational side view in partial section of the dual-mode lock in FIG. 1, shown unlocked by the combination lock assembly.
Figure 11:
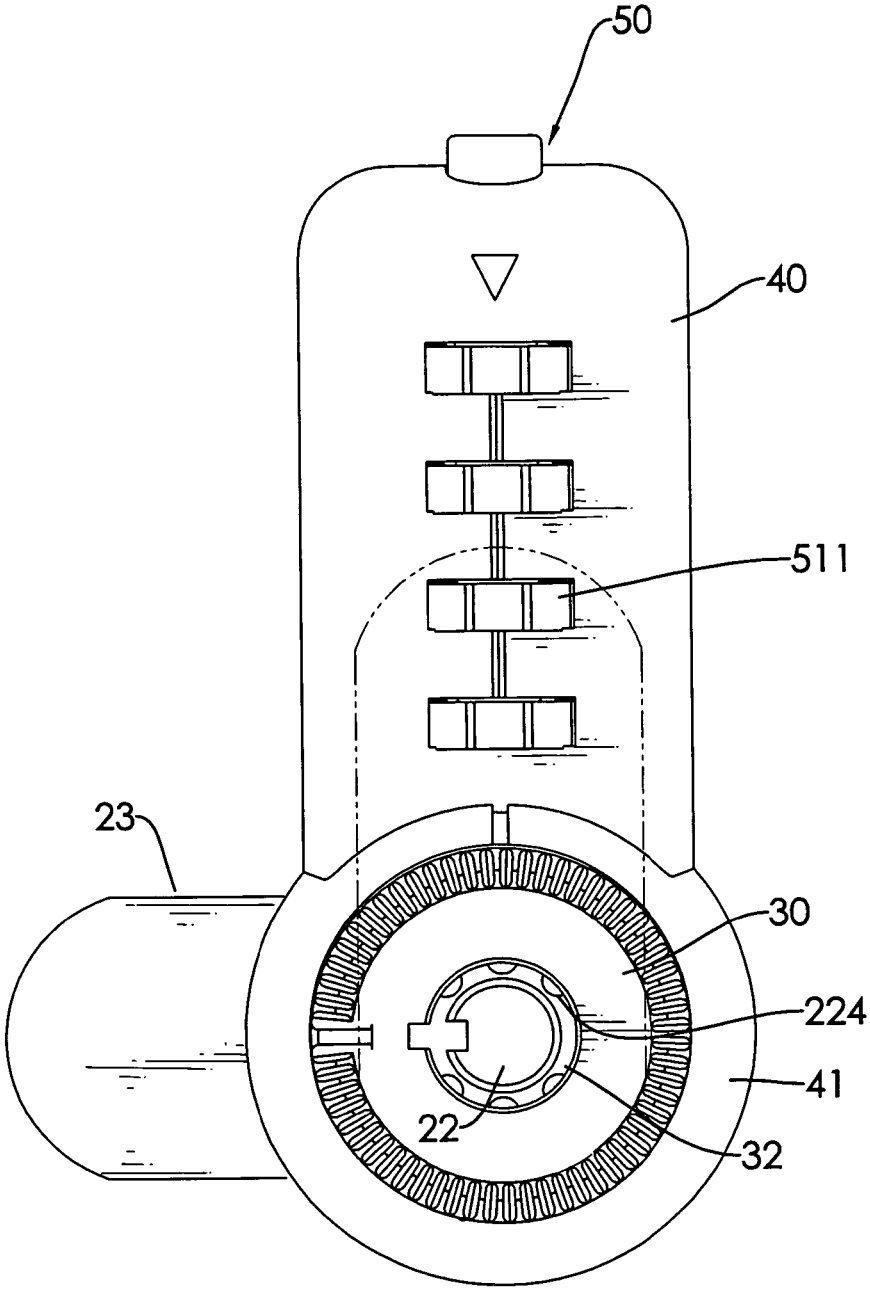
FIG. 11 is an operational front view of the dual-mode lock in FIG. 1, shown being unlocked by the combination lock assembly.
Figure 12:
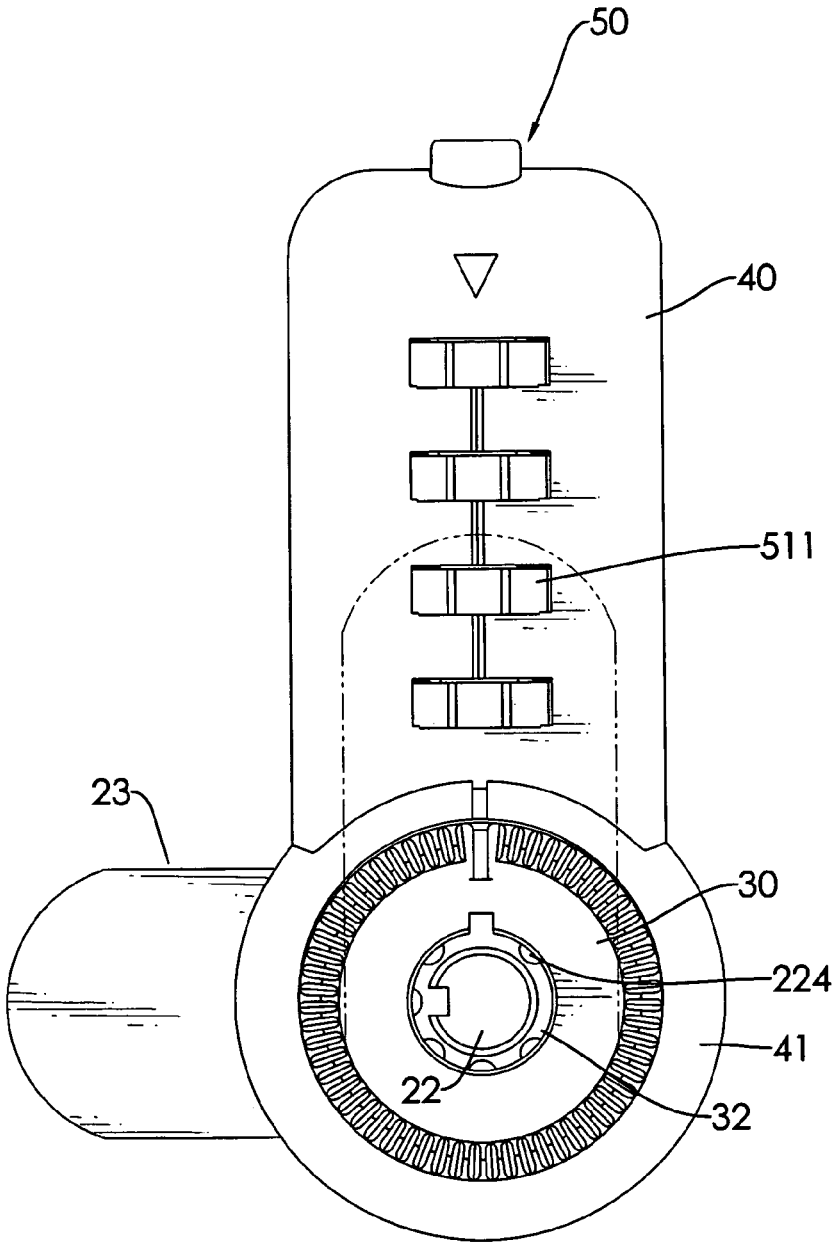
FIG. 12 is an operational front view of the dual-mode lock in FIG. 1, shown being unlocked by the corresponding key.

With further reference to FIGS. 10 to 12, the door of the locker may be unlocked by entering the correct combination then rotated by the knob (30) or by inserting a corresponding key to rotate the lock core (22) only.

Therefore, the dual-mode lock for a locker locks the door of the locker using a combination lock and a key lock. Therefore, if the combination is forgotten, accidentally changed or set up incorrectly changed, the door can be opened quickly using the corresponding key without damaging the lock, locker or requiring replacement of any parts.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dual-mode lock for a locker comprising a base having a through hole being formed coaxially through the base; and an engaging detent being formed transversely on an outer surface of the base near a front end;

a knob being rotatably attached coaxially to the front end of the base and having a lock core cavity being formed in a rear end of the knob and aligning with the through hole of the base; and an engaging detent being formed on an outer surface of the knob near the rear end and selectively aligning with the engaging detent of the base;

a key lock assembly being mounted in the lock core cavity of the knob, being mounted through the through hole of the base and having an inner core, being mounted adjacent to the base in the lock core cavity, engaging the knob and having a shaft hole being formed coaxially through the inner core and aligning with the through hole of the base;

a lock core, being mounted rotatably in the lock core cavity, selectively engaging the inner core and having a rear end abutting a front end of the inner core; and a shaft being formed on and protruding from the rear end of the lock core, being mounted rotatably through the shaft hole of the inner core and the through hole of the base, protruding out of a rear end of the base and having a distal end; and a latch being mounted securely on the distal end of the shaft;

a housing attached to the base having a proximal end being attached to the base; and a combination mount being formed from a distal end of the housing and having a combination core cavity being formed in the combination mount; and multiple windows being formed through a front side of the combination mount and communicating with the combination core cavity; and a combination lock assembly being mounted in the combination mount and having a combination lock core being mounted in the combination core cavity and having multiple dials being rotatably mounted coaxially in the combination core cavity, corresponding to and partially protruding through the windows;

multiple sleeves being tubular, being slidably mounted coaxially through the dials, engaging the dials, and each sleeve having a through hole being formed coaxially through the sleeve; and a rod being mounted rotatably through the through holes of the sleeves, being selectively slidable in the sleeves and having a bolt head being formed on an inner end of the rod, abutting the outer surface of the base near the front end and the outer surface of the knob near the rear end and selectively engaging the engaging detents of the base and the knob; and a spring being mounted around the rod and pressing against the sleeves and the rod.

2. The dual-mode lock for a locker as claimed in claim 1, wherein the inner core of the key lock assembly further has at least one pin chamber being formed longitudinally in the front end of the inner core;

at least one locking pin being mounted slidably in a corresponding pin chamber and selectively protruding out of the corresponding pin chamber; and at least one spring being mounted in a corresponding pin chamber and pressing against a corresponding locking pin; and the lock core of the key lock assembly further has at least one pin hole being formed longitudinally in the rear end of the lock core and aligning with a corresponding pin chamber, selectively engaging a corresponding locking pin, partially aligning with and communicating with a key groove; and at least one pushing pin being mounted slidably in a corresponding pin hole, pressing against the key groove and abutting a corresponding locking pin.

3. The dual-mode lock for a locker as claimed in claim 2, wherein the knob further has a key hole being formed through a front end of the knob and communicating and aligning with the lock core cavity; and the lock core of the key lock assembly further has the key groove being formed in a front end of the lock core and aligning with the key hole of the knob.

4. The dual-mode lock for a locker as claimed in claim 3, wherein the housing further has a knob mount being formed on the proximal end of the housing, being mounted around the front end of the base and the rear end of the knob, engaging the base and having a mounting hole being formed coaxially through the knob mount and being mounted around the front end of the base and the rear end of the knob; and an opening being formed transversely through the knob mount, corresponding to the engaging detents of the base and the knob.

5. The dual-mode lock for a locker as claimed in claim 4, wherein the combination mount further has a button mount being formed coaxially through a distal end of the combination mount and communicating with the combination core cavity; and the combination lock assembly further has a button being mounted slidably through the button mount and abutting a sleeve and selectively pushing the sleeves to disengage the dials.

6. The dual-mode lock for a locker as claimed in claim 5, wherein the base further has a limit being formed on and protruding longitudinally from the rear end of the base;

the key lock assembly further has a limiting ring being mounted securely on the distal end of the shaft and having two opposite positive stops, each positive stop corresponding to and selectively abutting the limit.

7. The dual-mode lock for a locker as claimed in claim 6, wherein the knob further has a mounting hole being formed in an inner surface of the knob and communicating with the lock core cavity;

the inner core further has an securing protrusion being mounted securely in the mounting hole of the knob.

8. The dual-mode lock for a locker as claimed in claim 7, wherein the combination mount further has multiple detecting holes being formed through a rear side of the combination mount, communicating with the combination core cavity and corresponding to the windows;

each sleeve further has a detecting opening corresponding to one of the detecting holes and selectively aligning with the corresponding detecting hole.

9. The dual-mode lock for a locker as claimed in claim 8, wherein the combination mount further comprises a combination mount base being formed on the housing; and a combination mount cover; and the detecting holes are formed through the combination mount cover.

10. The dual-mode lock for a locker as claimed in claim 9, wherein the engaging detent of the base, the engaging detent of the knob and the bolt head of the rod are V-shaped.

11. The dual-mode lock for a locker as claimed in claim 10, wherein the distal end of the shaft is keyed;

the latch has a keyed mounting hole corresponding to and being mounted securely around the distal end of the shaft.

12. The dual-mode lock for a locker as claimed in claim 11, wherein the key groove is circular.

* * * * *